US005731561A

United States Patent [19]

Manthe et al.

[11] Patent Number: 5,731,561

[45] Date of Patent: Mar. 24, 1998

[54] POWER SWITCH WITH AN ARC QUENCHING DEVICE

[75] Inventors: Karl-Heinz Manthe; Günter Seidler-Stahl, both of Berlin, Germany

[73] Assignee: Siemens Aktiengesellschaft, München, Germany

[21] Appl. No.: 619,488

[22] PCT Filed: Sep. 16, 1994

[86] PCT No.: PCT/DE94/01110

§ 371 Date: Jul. 31, 1996

§ 102(e) Date: Jul. 31, 1996

[87] PCT Pub. No.: WO95/08832

PCT Pub. Date: Mar. 30, 1995

[30] Foreign Application Priority Data

Sep. 24, 1993 [DE] Germany ..... 43 33 278.1

[51] Int. Cl.[6] ..... H01H 9/44

[52] U.S. Cl. ..... 218/35; 218/157; 335/201

[58] Field of Search ..... 200/288; 218/22, 218/34–41, 46, 47, 51, 52, 86, 88, 103, 104–106, 109, 148, 149–151, 155–158; 335/2, 6, 16, 38, 147, 185, 195, 201, 202

[56] References Cited

U.S. PATENT DOCUMENTS

| | | | |
|---|---|---|---|
| 2,293,452 | 8/1942 | Boehne | 200/144 |
| 3,243,559 | 3/1966 | Heft | 200/144 |
| 4,571,565 | 2/1986 | Belbel et al. | 335/16 |
| 4,650,946 | 3/1987 | Maier et al. | 200/288 |
| 5,153,545 | 10/1992 | Ferullo et al. | 335/201 |

FOREIGN PATENT DOCUMENTS

| | | | |
|---|---|---|---|
| 183 114 | 6/1986 | European Pat. Off. | H01H 9/34 |
| 1 194 613 | 11/1959 | France | H01H 9/34 |
| 1 021 054 | 12/1957 | Germany | H01H 9/366 |
| 1 185 269 | 1/1965 | Germany | H01H 9/345 |
| 1 690 463 | 5/1972 | Germany | H01H 9/36 |

*Primary Examiner*—Cassandra C. Spyrou
*Assistant Examiner*—Michael A. Friedhofer
*Attorney, Agent, or Firm*—Kenyon & Kenyon

[57] ABSTRACT

A power switch has a pole unit with a switch contact arrangement, an arc quenching device and a flow channel. Switching gases from the arc quenching device are provided into the flow channel and, after cooling, provided to the side of the switch contact arrangement away from the arc quenching device. The entire gas chamber of the power switch is essentially sealed. The flow channel may include a valve flap and a deionising device.

9 Claims, 2 Drawing Sheets

POWER SWITCH WITH AN ARC QUENCHING DEVICE

FIELD OF THE INVENTION

The present invention relates to an electrical power switch.

BACKGROUND OF THE INVENTION

A power switch has been disclosed by the French Patent. No. 1 194 613. For the operation of this power switch, it is essential that a movement of the gas volume take place inside the sealed gas chamber. The thermal buoyancy of the switching arc at the switch contact arrangement contributes to this. An influence acting toward the same end can be exerted on the switching arc by a suitable configuration of the power lead-in to the switching contact arrangement, by the fact that an electrodynamic loop force occurs. Overlaid on the two aforesaid influences, however, immediately upon opening of the contact elements of the switch contact arrangement, is a strong pressure surge associated with striking of the switching arc. The effect of this pressure surge in the sealed gas chamber can cause the desired movement of the switching arc to be impeded or even temporarily reversed. This results in reduced switching capacity and increased wear of the switch contact arrangement.

SUMMARY OF THE INVENTION

The present invention relates an electrical power switch with a switch contact arrangement having one stationary and one movable contact element, a drive apparatus for closing and opening the switch contact arrangement, an insulating housing receiving the switch contact arrangement as well as connector bars joining it to an external power circuit, an arc quenching device having arc splitters, with an inlet opening facing the contact elements and an outlet opening facing away from the contact elements, and a chamber, adjoining the outlet opening, providing additional cooling of switching gases emerging from the arc quenching device.

It is the object of the present invention, in a power switch with a sealed gas chamber, to achieve reliable forward movement of the switching arc on the contact elements.

The described object is achieved, according to an embodiment of the present invention, by having an electrical power switch with an arc quenching device having arc splitters, gas baffles deflecting the switching gases into the flow channel which are arranged at the outlet opening of the arc quenching device, a valve active in the flow direction of the switching gases being arranged in the flow channel on the side of the contact elements facing away from the inlet opening of the arc quenching device, where the flow channel includes a contour which fits in approximately curved fashion around the switch contact arrangement.

The use of an arc quenching device with arc splitters in power switches is known in the art as disclosed in the German Reference No. DE 1 021 054. In conjunction with this, it is also known to arrange a valve active in the flow direction of the switching gases at the movable contact element. As a result, the switching gases can move only in the desired direction, and a switching arc is quickly moved from the contact elements to the arc splitters.

In the electrical power switch according to the present invention, an increase in switching power level is achieved by means of the gas baffles in conjunction with the curved contour of the flow channel, while retaining the essential advantage that no switching gases are emitted to the outside.

Moreover, with the electrical power switch according to the present invention, it is not necessary to connect the valve to the movable contact element. Instead, the valve can be configured as a valve flap to be opened by the switching gases and the valve may return to its blocking position in response to gravity. An arrangement according to the present invention proves to be robust and reliable with regard to the stresses occurring during operation of a power switch.

The strength of a flow of switching gases in the flow channel depends on the magnitude of the particular current being interrupted. This phenomenon can be utilized, in particular, for rapid tripping of current-limiting power switches. According to another embodiment of the present invention, a movable tripping member may be used for this purpose. When gas flow of a certain strength occurs, the movable tripping member acts upon the drive apparatus so as to open the contact elements. The tripping memeber can be arranged in the flow channel. The tripping member can, for example, be joined to the tripping shaft in the breaker mechanism of the power switch.

These types of power switches, according to the present invention, generally have a configuration which takes into account the thermal buoyancy of a switching arc. One such power switch, according to one embodiment of the present invention, in which the arc quenching device is located above the switch contact arrangement, a section of the flow channel adjoining the arc quenching device can precede the arc quenching device in the direction of the switching movement of the movable contact element, a further section of the flow channel preceding the switch contact arrangement and being arranged with a flush transition into the first section of the flow channel. As a result the width of the power switch remains unchanged as compared to the usual arrangement, while in the depth direction a small additional space is required for the flow channel. The flow channel can be incorporated in design terms into the structure of the power switch, in such a way that a common insulating housing, dimensioned to receive the switch contact arrangement, the arc quenching device, and the flow channel, is provided, the arc quenching device and the first section of the flow channel having a separate common quenching chamber housing that can be inserted into the pole housing.

With reference to the position of the flow channel relative to the switch contact arrangement and the arc quenching device, an advantageous configuration where the flow channel is arranged, with respect to the plane of the switching movement of the movable contact element of the switch contact arrangement, beside the arc quenching device or beside the switch contact arrangement. With this configuration, the space requirement for the flow channel does not affect the depth of the power switch. Each pole of a multi-pole power switch can possess a pole carrier with a cross-sectional shape corresponding approximately to an asymmetrical "H", the crosspiece of the "H" shape, in conjunction with wall elements sealing off the pole carrier, forming in each case a larger space to receive the switch contact arrangement and a smaller space to form at least a portion of the flow channel. The pole carrier can, however, be dimensioned with a lower height, when this corresponds to the common height of switch contact arrangement and arc quenching device. For example, the arc quenching device and a first section of the flow channel can be accommodated in a common quenching chamber housing to be placed onto the pole carrier.

DETAILED DESCRIPTION

Figure 1:
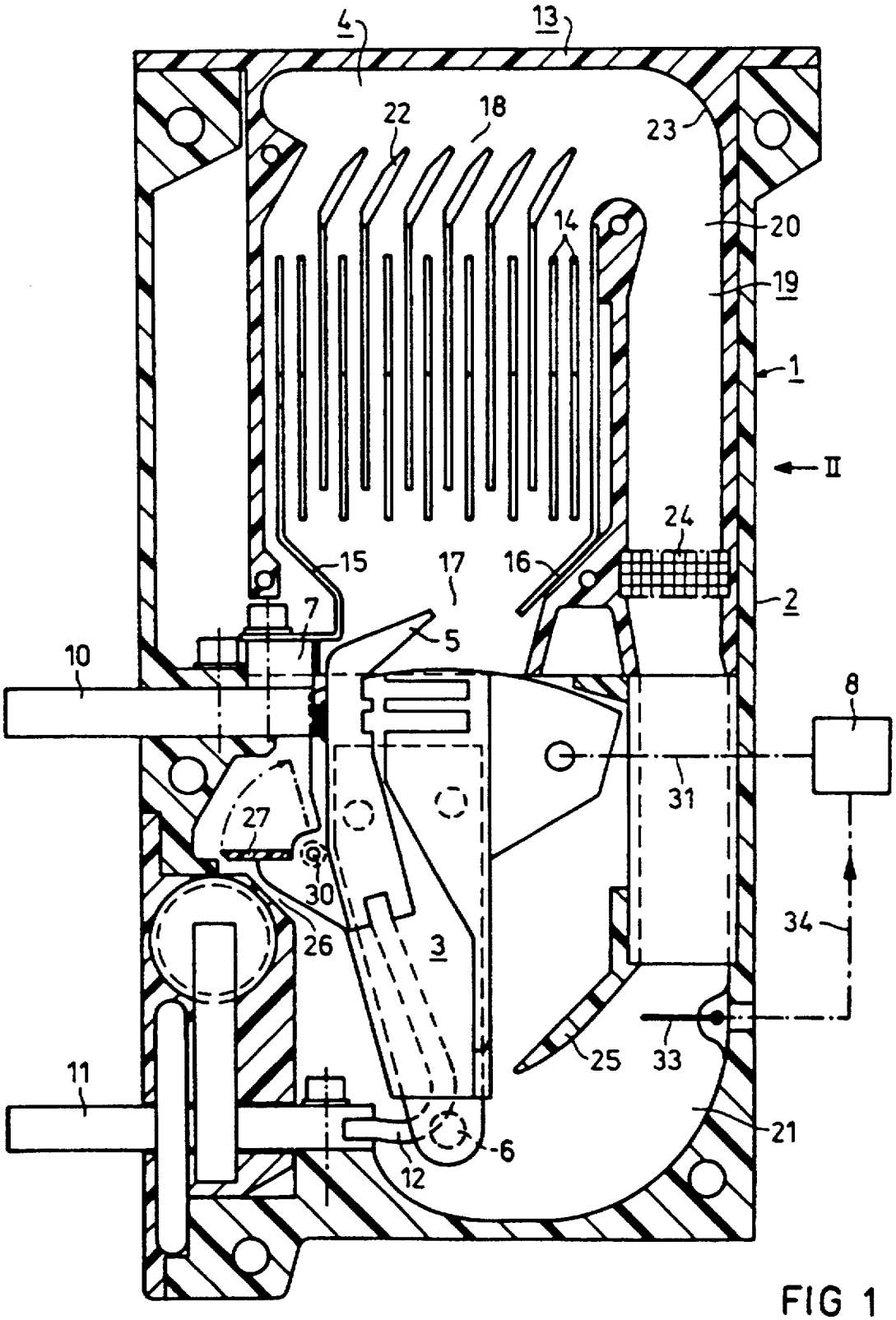
FIG. 1 illustrates a low-voltage power switch with insulating housing, partly in lateral cross-section, according to the present invention.

FIG. 1 shows a pole unit 1 of a low-voltage power switch which includes a common insulating housing 2 for a switch contact arrangement 3 and an arc quenching device 4. Switch contact arrangement 3, located in the lower part of insulating housing 2, has a movable contact element 5, configured as a contact lever, that is pivotable about a pivot bearing 6. The switched-off position is produced in known manner by a pivot motion of contact element 5 clockwise about pivot bearing 6. Movable contact element 5 interacts with a stationary contact element 7 that is installed directly on a connector bar 10 which passes outward through one wall of insulating housing 2. In a parallel arrangement to the upper connector bar 10, pole unit 1 has a lower connector bar 11 whose inner end is joined by means of a flexible conductor 12 to movable contact element 5. Movable contact element 5 is actuated, in a manner not depicted in further detail, by a schematically indicated drive apparatus 8 in order to switch pole unit 1 on and off.

The aforementioned arc quenching device 4 is located in insulating housing 2 above switch contact arrangement 3. It has a separate quenching chamber housing 13 that can be introduced from above into insulating housing 2 of pole unit 1 and is to be connected to it. Arc quenching device 4 has arc splitters 14 arranged in a known manner parallel to one another, as well as two arc guide bars 15 and 16 delimiting the arrangement of arc splitters 14, of which arc guide bar 15 is joined to stationary contact element 7. An inlet opening of the arc quenching device is labeled 17, and an outlet opening 18.

Another feature of pole unit 1 is a flow channel 19, the first, upper section 20 of which is contained in quenching chamber housing 13, while a second, lower section 21 is delimited only by wall elements of insulating housing 2. Flow channel 19 thus lies precedes switch contact arrangement 3 and arc quenching device 4 when pole unit 1 is viewed in the direction of arrow II in FIG. 1, which coincides with the direction in which a complete power switch is viewed. In order to facilitate the passage of switching gases emerging between arc splitters 14 into flow channel 19, quenching chamber housing 13 is equipped in the region of outlet opening 18 with gas baffles 22 and a rounded wall element 23. An apparatus 24 for deionizing and cooling the switching gases is located at the lower end of first section 20 of flow channel 19. This can be an arrangement of perforated panels, drawn metal, wire cloth, or similar means. Again in order to achieve a low flow resistance, the lower part of second section 21 of flow channel 19 is curved or trough-shaped. A fin 25 in insulating housing 2 ensures that the air or switching gases are directed approximately as far as pivot bearing 6 of movable contact element 5, and because of the relative closeness of the end of gas deflection fin 25 and pivot bearing 6, no noteworthy leakage due to the pivot movement of movable contact element 5 occurs. Flow channel 19 is supplemented by a nozzle section 26 that is located below stationary contact element 7 and that, with pole unit 1 in the resting state, is more or less completely sealed by a valve 27 configured so as to pivot like a flap. Valve 27 assumes the rest position depicted in response to gravity, and can move about a pivot bearing 30 no farther than the end position depicted with dot-dash lines, which is sufficiently far away from a vertical dead center position.

As already mentioned, switch contact arrangement 3 is connected to a drive apparatus 8. This can, as indicated in FIG. 1, preferably precede insulating housing 2 on the right side in FIG. 1, and can be joined to movable contact element 5 by means of a linkage rod. A linkage rod 31 of this kind can penetrate through a shaft 32 as indicated schematically in FIG. 2. Since linkage rod 31 represents only a narrow component, the space requirement for shaft 32 is also small, so that flow channel 19 is only slightly constricted.

Below shaft 32, flow channel 19 can also contain a tripping member 33 configured as a swinging flap, which is suitable for fast tripping of the breaker mechanism of a current-limiting power switch. This is indicated in FIG. 1 by a dot-dash connecting line 34 between tripping member 33 and drive apparatus 8.

Figure 2:
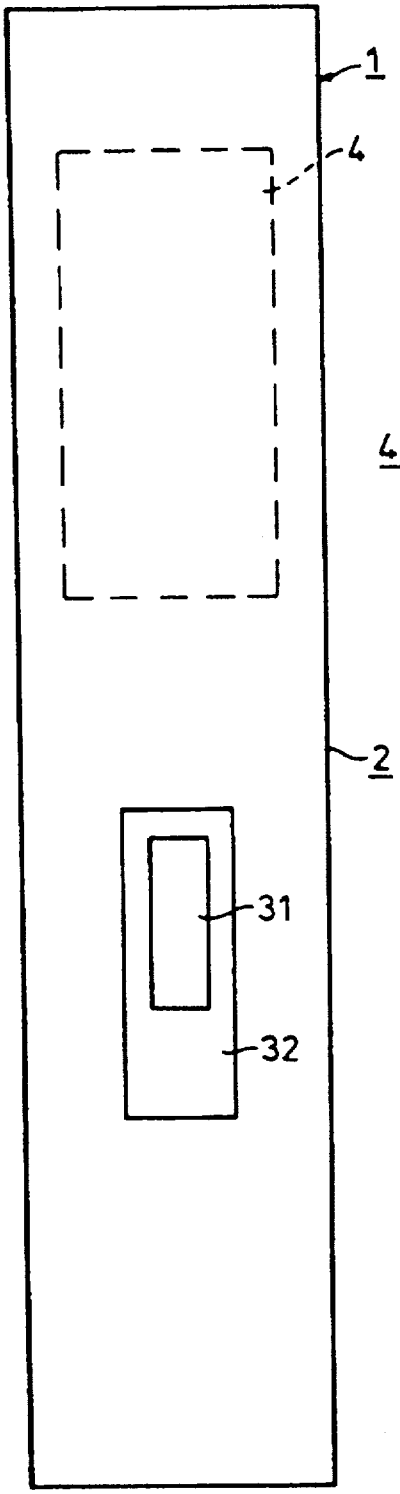
FIG. 2 depicts a pole unit, partly sectioned, in accordance with FIG. 1, in the direction of arrow II.

The operation of pole unit 1 depicted in FIGS. 1 and 2 using an assumption that in response to a short circuit, a very high current is flowing through connector bars 10 and 11 and switch contact arrangement 3. When movable contact element 5 is moved, starting from the switched-on position shown in FIG. 1, into its switched-off position, a switching arc occurs between movable contact element 5 and stationary contact element 7. Associated with this procedure is an explosive pressure wave that expands in all directions and acts, in particular, both in the direction of inlet opening 17 of arc quenching device 4, and in the opposite direction. Electromagnetic loop forces, however, cause the switching arc to be propelled toward arc quenching device 4. Propagation in this direction is aided by the fact that valve 30 reflects the pressure wave and thus exerts an additional propulsive force on the switching arc toward arc quenching device 4. Because of the substantially greater cross section of arc quenching device 4 as compared with the space below contact elements 5 and 7, the pressure wave can expand essentially unimpeded in the direction of arc quenching device 4o The result there, especially after passage of the switching arc onto arc guide bars 15 and 16, and the associated elongation and contact with a greater volume of air, is a gas flow that is deflected by gas baffles 22 into flow channel 19. At outlet opening 18 of arc quenching device 4, residual charge carriers are neutralized by contact with the wall surfaces in first section 20 of flow channel 19 and, as the flow proceeds, in apparatus 24. All that arrives at the lower end of flow channel 19, i.e. in the curved part of lower section 21, is air or switching gas that is substantially free of metal vapor and conductive constituents. The flow causes valve 27 to open, so that the gas flow now passes between the opened contact elements 5 and 7, effects gas exchange there and, in particular, eliminates the danger of a restrike. At the same time, forward motion of the switching arc between arc splitters 14 is accelerated and arc quenching thereby promoted, since the roots of the arc are moved more quickly over cold sections of arc splitters 14. As a result, the new arrangement has a considerably increased switching capacity. At the same time, there is no ejection of gas, since the expansion and cooling of the air used as the quenching medium occur in a sealed system.

The gas flow in flow channel 19 continues even when the current experiences a zero transition, and comes to a halt, due to pressure equalization, only after the quenching procedure is complete. This property prevents the roots of the arc from jumping back in the course of the quenching procedure, and improves electrical strength at open arc gaps.

To construct a multi-pole power switch, a plurality of pole units 1 shown in FIGS. 1 and 2 can be arranged next to one another as indicated with dot-dash lines in FIG. 2. A further embodiment suitable for the construction of multi-pole power switches will now be explained with reference to FIGS. 3 and 4. Each of pole units 40 as shown in FIG. 3 has a pole carrier 41 that essentially has a schematically indicated switch contact arrangement 42 and onto which a quenching chamber unit 43 is placed.

Figure 4:
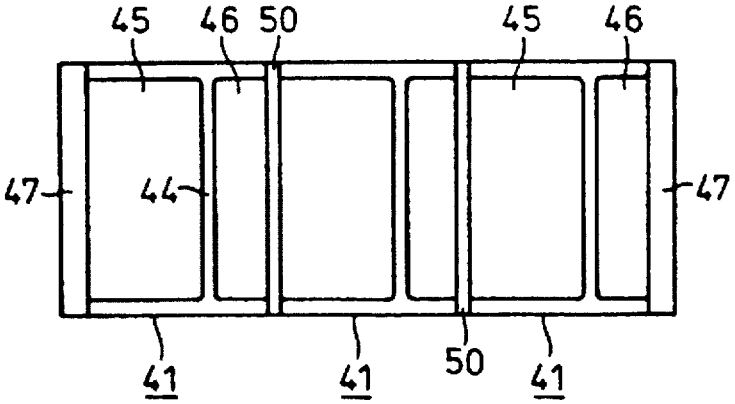
FIG. 4 illustrates a plan view of the pole units in accordance with FIG. 3, with the arc quenching device removed.

As shown in FIG. 4, each of pole carriers 41 has in cross-section the shape of an asymmetrical "H", the crosspiece 44 of the H shape forming a larger space 45 to receive switch contact arrangement 42, and a smaller space 46. Spaces 45 and 46 are sealed by lateral end walls 47 and partition walls 50. A flow channel 51 is arranged alongside switch contact arrangement 42. A first upper section 52 of flow channel 51 is contained in quenching chamber housing 43, specifically beside an actual arc quenching device 53. A second, lower section 54 of flow channel 51 is entirely or partially formed by smaller space 46 in pole carrier 41.

Figure 3:
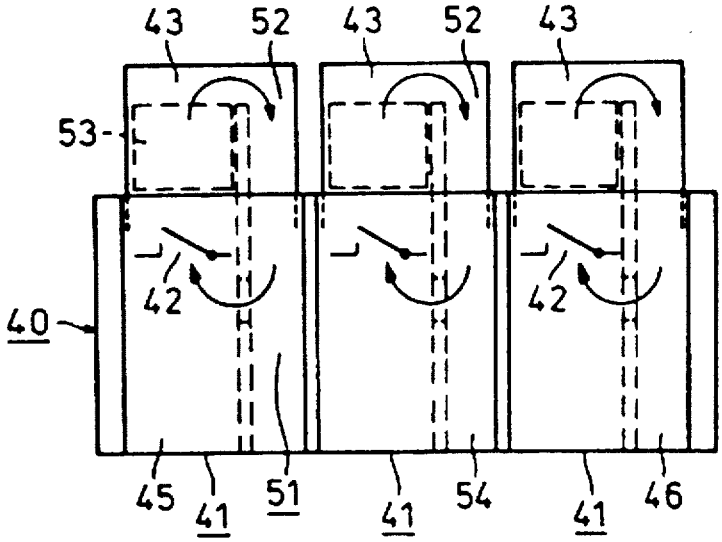
FIG. 3 shows a schematic depiction illustration of switch poles of a three-pole low-voltage power switch.

As is evident, the design shown in FIGS. 3 and 4 allows the construction of power switches with any number of pole units, such that both the number of poles and the number of units, connected in parallel, per pole can be selected.

We claim:

1. An electrical power switch having connector bars for joining to an external power circuit, the electrical power switch comprising:

a switch contact arrangement having a stationary contact element and a movable contact element;

a drive apparatus coupled to the movable contact element for opening and closing the switch contact arrangement;

an arc quenching device having at least one arc slitter, an inlet opening facing the contact elements and an outlet opening facing away from the contact elements, the arc quenching device providing switching gases;

a flow channel adjoining the outlet opening for cooling the switching gases emerging from the arc quenching device and being curve-shaped for substantially fitting around the switch contact arrangement, the flow channel directing the switching gases to a side of the contact elements facing away from the inlet opening of the arc quenching device, the arc quenching device and the flow channel forming a sealed gas chamber;

at least one gas baffle for deflecting the switching gases into the flow channel, the at least one gas baffle arranged substantially at the outlet opening of the arc quenching device; and a valve movable in a flow direction of the switching gases, the valve situated in the flow channel substantially near the contact elements and facing away from the inlet opening of the arc quenching device.

2. The electrical power switch according to claim 1, wherein the valve includes a valve flap opened by the switching gases and closed by gravity.

3. The electrical power switch according to claim 1, further comprising a movable tripping member coupled to the drive apparatus and provided in the flow channel, the tripping member actuating the drive apparatus to open the contact elements when the switching gases flow at a predetermined strength.

4. The electrical power switch according to claim 1, wherein the arc quenching device is situated above the switch contact arrangement.

5. The electrical power switch according to claim 4, wherein the flow channel includes a first section and a second section, the first section adjoining the arc quenching device and positioned preceding the arc quenching device in relation to a switching movement of the movable contact element, the second section positioned preceding the switch contact arrangement and coupled to the first section with a flush transition.

6. The electrical power switch according to claim 1, further comprising a common insulating housing for housing the switch contact arrangement, the arc quenching device and the flow channel, the arc quenching device and the first section forming a quenching chamber housing being situated in the insulating housing.

7. The electrical power switch according to claim 1, wherein the flow channel is arranged substantially at or near one of the arc quenching device and the switch contact arrangement.

8. The electrical power switch according to claim 7, further comprising:

a plurality of wall elements; and at least one pole each having a pole carrier with a substantially asymmetrical "H" shape, the pole carrier having a crosspiece for sealing off the pole carrier in conjunction with the wall elements, the pole carrier establishing a first area to receive the switch contact arrangement and a second area to form at least a portion of the flow channel.

9. The electrical power switch according to claim 8, further comprising a common quenching chamber housing having an arc quenching device and a first section, the common quenching chamber housing being placed on the pole carrier.

* * * * *